US008491674B2

(12) United States Patent
Kawamoto

(10) Patent No.: US 8,491,674 B2
(45) Date of Patent: Jul. 23, 2013

(54) FLOW IMPROVER FOR BIODIESEL FUELS

(75) Inventor: Hideki Kawamoto, Hyogo (JP)

(73) Assignee: NOF Corporation, Tokyo (JP)

( * ) Notice: Subject to any disclaimer, the term of this patent is extended or adjusted under 35 U.S.C. 154(b) by 80 days.

(21) Appl. No.: 13/088,872

(22) Filed: Apr. 18, 2011

(65) Prior Publication Data

US 2011/0258909 A1 Oct. 27, 2011

(30) Foreign Application Priority Data

Apr. 22, 2010 (JP) ..... 2010-099290

(51) Int. Cl.
*C10L 1/10* (2006.01)
*C10L 1/00* (2006.01)
*C10L 1/18* (2006.01)

(52) U.S. Cl.
USPC ..... 44/300; 44/307; 44/393

(58) Field of Classification Search
USPC ..... 44/300, 307, 418, 393
See application file for complete search history.

(56) References Cited

U.S. PATENT DOCUMENTS

| | | | |
|---|---|---|---|
| 5,389,113 | A | 2/1995 | Demmering et al. |
| 2005/0183326 | A1 | 8/2005 | Lin et al. |

FOREIGN PATENT DOCUMENTS

| | | | |
|---|---|---|---|
| CA | 2311545 | | 6/1999 |
| EP | 0563070 | B1 | 10/1995 |
| JP | 2001-524578 | | 12/2001 |
| JP | 2005-015798 | | 1/2005 |
| JP | 2010100732 | A * | 5/2010 |

OTHER PUBLICATIONS

English Translation of JP 2010-100732A.*

* cited by examiner

*Primary Examiner* — James Goloboy
*Assistant Examiner* — Latosha Hines
(74) *Attorney, Agent, or Firm* — Rankin, Hill & Clark LLP

(57) ABSTRACT

A flow improver for biodiesel fuels, comprising an α-olefin polymer with a weight average molecular weight of 50,000 to 500,000 that is obtained by polymerization of an α-olefin mixture (C), wherein the mole ratio (A)/(B) of an α-olefin (A) with 10 carbon atoms and an α-olefin (B) with 14 to 18 carbon atoms is (A)/(B)=10/90 to 60/40.

4 Claims, No Drawings

FLOW IMPROVER FOR BIODIESEL FUELS

BACKGROUND OF THE INVENTION

1. Field of the Invention

The present invention relates to a flow improver for biodiesel fuels that can improve low temperature stability in relation to a cold filter plugging point (hereinafter referred to plugging point), a pour point, or the like. The present invention relates also to a biodiesel fuel composition with excellent low temperature stability.

2. Background Art

In recent years, due to concern over depletion of fossil fuels such as petroleum and coal, the effective utilization of natural energy like solar light, wind power, and hydraulic power, and of biomass fuels derived from animals and plants is being tested. Furthermore, particular focus is being given to plant-based biomass fuels due to their contribution to carbon dioxide reduction on a global scale. In the case of plant-based biomass fuels, plants are processed and used as a source of carbon. Thus, because the carbon dioxide emitted by plants and trees is again absorbed by plants and trees due to photosynthesis and is cycled, it is considered that it does not affect the carbon dioxide concentration at the global level. Such fuels have a status of carbon neutral fuels.

Plant-based biomass fuels, such as ethanol obtained by fermenting sugarcane and whole grains like corn, and ethyl tertiary butyl ether obtained by reacting ethanol and isobutene are being examined as alternative fuels for use in gasoline-powered vehicles.

On the other hand, fuels using animal and plant-based fats and oils as basic ingredients, also known as biodiesel fuels, are generally used as biomass fuel in diesel vehicles. Since the animal and plant-based fats and oils have a high boiling point and high viscosity, they are not adapted for use without modification in the form of diesel fuel. Therefore, a biodiesel fuel includes animal and plant-based fats and oils that are processed and converted to a fuel having physical properties, such as a boiling point range and viscosity, that are close to the physical properties of light diesel oil.

The most commonly used components are fatty acid esters such as fatty acid methyl ester and fatty acid ethyl ester, which are derived from animal and plant-based fats and oils. However, compared to light diesel oils, biodiesel fuels made from fatty acid esters, such as fatty acid methyl ester and fatty acid ethyl ester tend to have reduced stability at low temperatures. Since fatty acid esters obtained from animal and plant-based oils and fats possess fatty acid distribution derived from the oils and fats used as the raw material, they have various low-temperature characteristics, such as a plugging point and a pour point. Generally, biodiesel fuels containing a large amount of saturated fatty acid methyl ester and saturated fatty acid ethyl ester manufactured by using fats and oils with a high content of saturated fatty acids as the raw material have reduced stability at low temperatures and declined flow characteristics. Therefore, the period and place of their usage are restricted.

However, with reference to the current energy situation, there is a need to use fatty acid esters, such as fatty acid methyl ester and fatty acid ethyl ester obtained by using various fats and oils as the raw material, and from the viewpoint of economic efficiency and supply stability, even the use of fatty acid esters with poor stability at low temperatures that use fats and oils with a high content of saturated fatty acids as the raw material is being widely examined.

On the other hand, flow improvers for middle distillates that are used in middle distillates such as light diesel oil and heavy fuel oil A are known to have almost no effect when used on fatty acid esters without modification. In light of this situation, various low temperature flow improvers have been disclosed as a flow improver for middle distillates to enable use of biodiesel fuels by improving the stability of fatty acid esters at low temperatures. For example, Patent Literature 1 discloses that a mixture of esters of polymers and copolymers of acrylic and/or methacrylic acids and alcohols containing from 1 to 22 carbon atoms can improve the low temperature stability of fatty acid methyl ester. Moreover, Patent Literature 2 discloses an additive for biodiesel fuels formed from a copolymer of alkyl methacrylate containing 8 to 30 carbon atoms in the alkyl group, polyoxyalkylene alkyl methacrylate containing 1 to 20 carbon atoms in the alkyl group, and alkyl methacrylate containing 1 to 4 carbon atoms in the alkyl group. Furthermore, Patent Literature 3 discloses a low temperature flow improver for methyl ester of animal or plant origin formed from an ethylene-vinyl ester copolymer containing 17 mole percent or more of vinyl ester unit and also containing five or more alkyl branches for every 100 units of methylene in the main chain.

However, in spite of the fact that low temperature flow improvers using such copolymers exhibited an improvement in fluidity at low temperatures for some fatty acid esters, they were not sufficient for fatty acid esters with different types of fatty acid compositions, particularly fatty acid esters with a high content of saturated fatty acid esters. Therefore, there is a need for a flow improver for biodiesel fuels with excellent stability improvement effect at low temperatures for fatty acid esters with various fatty acid compositions.

Citation List

Patent Literature

[Patent Literature 1] European Patent No. 0563070

[Patent Literature 2] Japanese Unexamined Patent Application Publication (Translation of PCT Application) No. 2001-524578

[Patent Literature 3] Japanese Unexamined Patent Application Publication No. 2005-015798

SUMMARY OF THE INVENTION

The present invention solves the above-mentioned problems and an object thereof is to provide a flow improver for biodiesel fuels having a stability improvement effect at low temperatures such as plugging point improvement effect and pour point improvement effect, and also to provide a biodiesel fuel composition with excellent low temperature stability, which comprises such a flow improver.

Solution to Problem

As a result of intensive studies to solve the above-mentioned problem, the present inventors had the insight that a specific α-olefin polymer imparts a stability improvement effect at low temperatures, such as plugging point improvement effect and pour point improvement effect, for biodiesel fuels with various fatty acid compositions.

That is, the flow improver for biodiesel fuels described in the present invention includes an α-olefin polymer with a weight average molecular weight of 50,000 to 500,000 that is obtained by polymerization of an α-olefin mixture (C), wherein the mole ratio (A)/(B) of an α-olefin (A) with 10 carbon atoms and an α-olefin (B) with 14 to 18 carbon atoms is (A)/(B)=10/90 to 60/40.

Furthermore, the biodiesel fuel composition of the present invention contains 10 to 10,000 ppm of the flow improver of the present invention with respect to the biodiesel fuel.

Advantageous Effects of the Invention

The flow improver for biodiesel fuels described in the present invention can impart a stability improvement effect at low temperatures such as plugging point improvement effect and pour point improvement effect for a biodiesel fuel including various fatty acid compositions. Particularly, it can impart a stability improvement effect at low temperatures such as plugging point improvement effect and pour point improvement effect even for a biodiesel fuel with a high content of saturated fatty acid esters. Thus, by including the additive for a biodiesel fuel described in the present invention in a biodiesel fuel, a biodiesel fuel composition with excellent low temperature stability is obtained.

DETAILED DESCRIPTION OF THE INVENTION

Hereinafter, the present invention is described in more detail.

The flow improver for biodiesel fuels described in the present invention includes an α-olefin polymer with a weight average molecular weight is 50,000 to 500,000.

The α-olefin polymer according to the present invention is obtained by polymerization of an α-olefin mixture (C) of an α-olefin (A) with 10 carbon atoms and an α-olefin (B) with 14 to 18 carbon atoms.

The component (A) used in the present invention is an α-olefin with 10 carbon atoms. Particularly, 1-decene is used.

The component (B) used in the present invention is an α-olefin with 14 to 18 carbon atoms. Particularly, 1-tetradecene, 1-pentadecene, 1-hexadecene, 1-heptadecene, and 1-octadecene may be used. These may be used either separately or as a mixture to form the component (B).

The α-olefin mixture (C) used in the present invention is an α-olefin mixture, wherein the mole ratio (A)/(B) of an α-olefin (A) with 10 carbon atoms and an α-olefin (B) with 14 to 18 carbon atoms is (A)/(B)=10/90 to 60/40, and particularly desired is (A)/(B)=15/85 to 55/45. In an α-olefin polymer obtained by polymerization of an α-olefin mixture whose mole ratio (A)/(B) is outside the above-mentioned range, the stability improvement effect at low temperatures may not be obtained for biodiesel fuels.

As far as the α-olefin mixture (C) made from the component (A) and component (B) according to the present invention is concerned, a mole average carbon number of from 13.0 to 15.5 is desired because such a mixture shows increased stability improvement effect at comparatively low temperatures for a wide range of biodiesel fuels. A more desired mole average carbon number is from 13.5 to 15.0.

The α-olefin polymer described in the present invention can be obtained by polymerization of the above-mentioned α-olefin mixture (C). As regards the molecular weight of the α-olefin polymer, the weight average molecular weight is between 50,000 and 500,000, and the desired range is between 50,000 and 300,000. If the weight average molecular weight of the α-olefin polymer is less than 50,000, the stability improvement effect at low temperatures may not be obtained when it is added to the biodiesel fuel. Furthermore, if the weight average molecular weight of the α-olefin polymer exceeds 500,000, the viscosity of the α-olefin polymer increases, and therefore, suction by a pump during operation becomes difficult and addition of solvents for dilution further makes the operation complex, which is not desirable. It is noted that the weight average molecular weight is the weight average molecular weight of polystyrene conversion based on gel permeation chromatography (GPC) method.

There are no particular restrictions regarding the biodiesel fuel according to the present invention, but the preferred biodiesel fuel is a fatty acid ester derived from animal and plant-based fats and oils. The above-mentioned fatty acid ester is obtained by the common procedure. For example, the method of obtaining the fatty acid ester by the transesterification of an animal and plant-based fat and oil and an alcohol, or the method of obtaining the fatty acid ester by performing hydrolysis of an animal or plant based fat and oil in a fatty acid and glycerin, and then performing a dehydration reaction between the fatty acid obtained by removing glycerin and an alcohol may be used. Methanol and ethanol are preferred to be used as the alcohol for obtaining the fatty acid ester.

The biodiesel fuel composition of the present invention contains 10 to 10,000 ppm of the biodiesel fuel flow improver according to the present invention relative to the biodiesel fuel. If the content is less than 10 ppm, it becomes difficult to achieve the stability improvement effect at low temperatures. Furthermore, if the content exceeds 10,000 ppm, the stability improvement effect proportionate to the content is not achieved at low temperatures. The preferred content is between 100 and 8000 ppm, and still more preferred content is between 200 and 6000 ppm.

In the biodiesel fuel composition of the present invention, if desired, various additives used conventionally as additives for petroleum fuel oil, such as cloud point depressants, rust inhibitors, anti-oxidants, cetane improvers, metal deactivators, detergent dispersants, combustion improvers, black smoke reducers, anti-foaming agents, color stabilizing agents, deicing agents, sludge dispersants, and markers can be included together with the earlier-mentioned flow improver.

EXAMPLE

Hereinafter, the present invention is explained more specifically by citing examples.

(1) Example of Manufacture of an α-Olefin Polymer (Polymer 1)

Nitrogen was substituted inside a glove box. The oxygen concentration was measured to be 0.01%. The following polymerization reaction was performed inside the glove box.

A 200-ml four-necked flask equipped with an agitator, a nitrogen inlet tube, a thermometer, and an addition funnel was introduced with 0.15 g of titanium trichloride (Solvay catalyst: Manufactured by Tosoh Finechem Corporation) and 100 ml of n-heptane. Furthermore, 7.5 ml of 1 mol/l diethyl aluminum chloride/n-heptane solution was introduced using a syringe.

After heating up the reaction liquid up to 90° C., 10.0 g of a mixture of 1.0 g (0.007 mol) of 1-decene and 9.0 g (0.046 mol) of 1-tetradecene was dripped, and then a polymerization reaction was performed for 1.5 hours at 90° C. After the elapse of 1.5 hours, 15 ml of 2-methyl-1-propanol was dropped gradually, the catalyst was deactivated, and polymerization was stopped.

After taking out the four-necked flask from the glove box, the reaction liquid was transferred to a separating funnel, 150 ml of warm water was added and shaken, and then left to stand, following which the separated water layer was removed. This operation was further repeated four times. The acquired purified product was decompressed to remove the solvent, and 5.0 g of polymer was obtained.

(Polymers 2 to 11)

The α-olefin mentioned in Table 1 was introduced at a weight mentioned in Table 1, polymerization was performed with the same procedure as the manufacturing method of polymer 1, and polymers 2 to 11, which are α-olefin polymers, were obtained. Table 1 lists the mole average carbon number and weight average molecular weight of each polymer 1 to 11.

TABLE 1

| | α-olefin with 10 carbon atoms(A) (Introduced weight:mol) | α-olefin with 14 to 18 carbon atoms (Introduced weight:mol) | other α-olefins (Introduced weight:mol) | A:B (mole %) | mole average carbon number | weight average molecular weight (Mw) |
|---|---|---|---|---|---|---|
| polymer 1 | 1-decene (1 g:0.007 mol) | 1-tetradecene (9 g:0.046 mol) | — | 13:87 | 13.5 | 158000 |
| polymer 2 | 1-decene (4 g:0.029 mol) | 1-hexadecene (16 g:0.071 mol) | — | 29:71 | 14.3 | 220000 |
| polymer 3 | 1-decene (1 g:0.007 mol) | 1-hexadecene (4 g:0.018 mol) | — | 29:71 | 14.3 | 59000 |
| polymer 4 | 1-decene (6 g:0.043 mol) | 1-hexadecene (24 g:0.107 mol) | — | 29:71 | 14.3 | 411000 |
| polymer 5 | 1-decene (8 g:0.057 mol) | 1-hexadecene (6 g:0.027 mol) 1-octadecene (6 g:0.024 mol) | — | 53:47 | 13.3 | 191000 |
| polymer 6 | 1-decene (4 g:0.029 mol) | 1-hexadecene (8 g:0.036 mol) 1-octadecene (8 g:0.032 mol) | — | 30:70 | 14.9 | 189000 |
| polymer 7 | — | 1-tetradecene (10 g:0.051 mol) | — | — | 14 | 135000 |
| polymer 8 | — | — | 1-dodecene (10 g:0.060 mol) | — | 12 | 117000 |
| polymer 9 | — | 1-hexadecene (10 g:0.045 mol) | — | — | 16 | 99000 |
| polymer 10 | 1-decene (3.5 g:0.025 mol) | 1-octadecene (16.5 g:0.065 mol) | | 28:72 | 15.8 | 179000 |
| polymer 11 | 1-decene (6 g:0.043 mol) | 1-tetradecene (4 g:0.020 mol) | | 68:32 | 11.3 | 123000 |

(2) Example of Synthesis of a Fatty Acid Ester (Synthesis of a Waste Cooking Oil Methyl Ester)

3000 g of waste cooking oil, 1370 g of methanol, and 7 g of potassium hydroxide was added to a 5-1 four-necked flask equipped with a nitrogen inlet tube, a thermometer, and a dimroth, and transesterification was performed for three hours at 60° C. After the reaction, washing was performed three times with warm water and the glycerin aqueous solution of the lower layer was separated. The crude waste cooling oil methyl ester of the upper layer was again fed into the four-necked flask, 1370 g of methanol and 5 g of potassium hydroxide was added, and transesterification was performed again. After the completion of the reaction, washing was performed three times with warm water, following which a solution of potassium hydroxide was added, and the free fatty acid was neutralized and rinsed. Again, washing was performed three times with warm water, and after confirming that the wash liquid is neutral, washing was completed. The ester after washing was decompressed up to 70° C. and 10 torr, and after dehydrating for one hour, waste cooking oil methyl ester was obtained.

(Synthesis of Waste Cooking Oil Ethyl Ester)

With the exception of substituting ethanol for methanol in the above-mentioned synthesis of the waste cooking oil methyl ester, the same procedure for synthesis was used to obtain a waste cooking oil ethyl ester.

(Synthesis of Palm Oil Methyl Ester)

With the exception of substituting palm oil for waste cooking oil in the above-mentioned synthesis of the waste cooking oil methyl ester, the same procedure for synthesis was used to obtain a palm oil methyl ester.

(Synthesis of Jatropha Oil Methyl Ester)

With the exception of substituting jatropha oil for waste cooking oil in the above-mentioned synthesis of the waste cooking oil methyl ester, the same procedure for synthesis was used to obtain a jatropha oil methyl ester.

The fatty acid compositions of waste cooking oil methyl ester, waste cooking oil ethyl ester, palm oil methyl ester, and jatropha oil methyl ester obtained above were analyzed respectively using gas chromatography. The analysis results are shown below in Table 2.

TABLE 2

| Fatty acid composition (%) | Waste cooking oil methyl ester | Waste cooking oil ethyl ester | Palm oil methyl ester | Jatropha oil methyl ester |
|---|---|---|---|---|
| Palmitic acid | 13.2 | 13.5 | 45.7 | 14.0 |
| Palmitoleic acid | 0.6 | 0.8 | — | — |
| Stearic acid | 4.0 | 3.9 | 4.2 | 6.5 |
| Oleic acid | 42.7 | 43.1 | 38.3 | 42.5 |
| Linoleic acid | 33.1 | 32.8 | 9.6 | 35.2 |
| Other fatty acids | 6.4 | 5.9 | 2.2 | 1.8 |

(Measurement of Pour Point of Waste Cooking Oil Methyl Ester)

Table 3 below lists the measurement results of the pour point when an α-olefin polymer was added to a waste cooking oil methyl ester. The pour point conforms to JIS K-2269, and was measured at intervals of 1° C. It is noted that polymers 1 to 11 described in Table 1, an ethylene-vinyl acetate copolymer, and an alkyl methacrylate copolymer were used as flow improvers.

TABLE 3

| | Flow improver | Addition amount (ppm) | Pour point (° C.) |
|---|---|---|---|
| Example 1 | Polymer 1 | 1000 | −22 |
| Example 2 | Polymer 2 | 500 | −42 |
| Example 3 | Polymer 2 | 1000 | −40 |
| Example 4 | Polymer 3 | 1000 | −29 |
| Example 5 | Polymer 4 | 500 | −35 |
| Example 6 | Polymer 5 | 500 | −32 |
| Example 7 | Polymer 6 | 500 | −35 |
| Comparative example 1 | — | 0 | −3 |
| Comparative example 2 | Polymer 7 | 1000 | −2 |
| Comparative example 3 | Polymer 7 | 2500 | −3 |
| Comparative example 4 | Polymer 8 | 2500 | −3 |
| Comparative example 5 | Polymer 9 | 2500 | −1 |
| Comparative example 6 | Polymer 11 | 2500 | −3 |
| Comparative example 7 | ethylene-vinyl acetate copolymer Remark 1) | 2500 | −6 |
| Comparative example 8 | alkyl methacrylate copolymer Remark 2) | 2500 | −8 |

Remark 1) Vinyl acetate content = 35 weight % and number average molecular weight = 3840
Remark 2) Lauryl methacrylate/myristyl methacrylate = 50/50 weight % and weight average molecular weight = 18000

(Measurement of Plugging Point of Waste Cooking Oil Methyl Ester)

Table 4 below lists the measurement results of the plugging point when an α-olefin polymer was added to a waste cooking oil methyl ester. The plugging point was measured according to JIS K-2288. It is noted that polymer 1 and polymer 4 described in Table 1, an ethylene-vinyl acetate copolymer, and an alkyl methacrylate copolymer were used as flow improvers.

TABLE 4

| | Flow improver | Addition amount (ppm) | Plugging point (° C.) |
|---|---|---|---|
| Example 8 | Polymer 1 | 2500 | −8 |
| Example 9 | Polymer 4 | 2500 | −7 |
| Comparative example 9 | — | 0 | −4 |
| Comparative example 10 | ethylene-vinyl acetate copolymer Remark 1) | 2500 | −5 |
| Comparative example 11 | alkyl methacrylate copolymer Remark 2) | 2500 | −3 |

Remark 1) Vinyl acetate content = 35 weight % and number average molecular weight = 3840
Remark 2) Lauryl methacrylate/myristyl methacrylate = 50/50 weight % and weight average molecular weight = 18000

(Measurement of Pour Point of Waste Cooking Oil Ethyl Ester)

Table 5 below lists the measurement results of the pour point when an α-olefin polymer was added to a waste cooking oil ethyl ester. The pour point conforms to JIS K-2269, and was measured at intervals of 1° C. It is noted that polymer 2, polymer 6, and polymer 10 described in Table 1, an ethylene-vinyl acetate copolymer, and an alkyl methacrylate copolymer were used as flow improvers.

TABLE 5

| | Flow improver | Addition amount (ppm) | Pour point (° C.) |
|---|---|---|---|
| Example 10 | Polymer 2 | 1000 | −43 |
| Example 11 | Polymer 6 | 1000 | −35 |
| Example 12 | Polymer 10 | 2500 | −25 |
| Comparative example 12 | — | 0 | −8 |
| Comparative example 13 | ethylene-vinyl acetate copolymer Remark 1) | 2500 | −12 |
| Comparative example 14 | alkyl methacrylate copolymer Remark 2) | 2500 | −15 |

Remark 1) Vinyl acetate content = 35 weight % and number average molecular weight = 3840
Remark 2) Lauryl methacrylate/myristyl methacrylate = 50/50 weight % and weight average molecular weight = 18000

(Measurement of Pour Point of Palm Oil Methyl Ester)

Table 6 below lists the measurement results of the pour point when an α-olefin polymer was added to a palm oil methyl ester. The pour point conforms to JIS K-2269, and was measured at intervals of 1° C. It is noted that polymer 3 and polymer 5 described in Table 1, an ethylene-vinyl acetate copolymer, and an alkyl methacrylate copolymer were used as flow improvers.

TABLE 6

| | Flow improver | Addition amount (ppm) | Pour point (° C.) |
|---|---|---|---|
| Example 13 | Polymer 3 | 5000 | 8 |
| Example 14 | Polymer 5 | 5000 | 7 |
| Comparative example 15 | — | 0 | 13 |
| Comparative example 16 | ethylene-vinyl acetate copolymer Remark 1) | 5000 | 12 |
| Comparative example 17 | alkyl methacrylate copolymer Remark 2) | 5000 | 11 |

Remark 1) Vinyl acetate content = 35 weight % and number average molecular weight = 3840
Remark 2) Lauryl methacrylate/myristyl methacrylate = 50/50 weight % and weight average molecular weight = 18000

(Measurement of Pour Point of Jatropha Oil Methyl Ester)

Table 7 below lists the measurement results of the pour point when an α-olefin polymer was added to a jatropha oil methyl ester. The pour point conforms to JIS K-2269, and was measured at intervals of 1° C. It is noted that polymer 2 and polymer 4 described in Table 1, an ethylene-vinyl acetate copolymer, and an alkyl methacrylate copolymer were used as flow improvers.

TABLE 7

| | Flow improver | Addition amount (ppm) | Pour point (° C.) |
|---|---|---|---|
| Example 15 | Polymer 2 | 2500 | −6 |
| Example 16 | Polymer 4 | 2500 | −5 |
| Comparative example 18 | — | 0 | 3 |
| Comparative example 19 | ethylene-vinyl acetate copolymer Remark 1) | 5000 | 2 |

TABLE 7-continued

| | Flow improver | Addition amount (ppm) | Pour point (° C.) |
|---|---|---|---|
| Comparative example 20 | alkyl methacrylate copolymer Remark 2) | 5000 | 1 |

Remark 1) Vinyl acetate content = 35 weight % and number average molecular weight = 3840
Remark 2) Lauryl methacrylate/myristyl methacrylate = 50/50 weight % and weight average molecular weight = 18000

As can also be understood from the results shown in Table 3 to Table 7, the flow improver for biodiesel fuels described in the present invention achieves a stability improvement effect at low temperatures, such as plugging point improvement effect and pour point improvement effect, for biodiesel fuels with the various fatty acid compositions shown in Table 2. Particularly, the stability improvement effect at low temperatures is achieved even for biodiesel fuels with a high content of esters of saturated fatty acid, such as palmitic acid and styrene acid.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding Japanese patent applications No. 2010/99290, filed Apr. 22, 2010 is incorporated by reference herein.

What is claimed:

1. A flow improver for biodiesel fuels, comprising an α-olefin polymer with a weight average molecular weight of 50,000 to 500,000 that is obtained by polymerization of an α-olefin mixture (C), wherein the mole ratio (A)/(B) of an α-olefin (A) with 10 carbon atoms and an α-olefin (B) with 14 to 18 carbon atoms in the α-olefin mixture (C) is 10/90 to 60/40.

2. The flow improver for biodiesel fuels according to claim 1, wherein a mole average carbon number of the α-olefin mixture (C) is from 13.0 to 15.5.

3. A biodiesel fuel composition, comprising a biodiesel fuel and 10 to 10,000 ppm of the flow improver for biodiesel fuels according to claim 1 with respect to the biodiesel fuel.

4. A method of using the flow improver for biodiesel fuels according to claim 1, the method comprising:

combining the flow improver for biodiesel fuels according to claim 1 with a biodiesel fuel to form a biodiesel fuel composition, the biodiesel fuel composition comprising 10 to 10,000 ppm of the flow improver with respect to the biodiesel fuel.

* * * * *